US006142346A

United States Patent [19]

Aderholt et al.

[11] Patent Number: 6,142,346

[45] Date of Patent: Nov. 7, 2000

[54] CLUSTER-TYPE RELIEF DEVICE

[76] Inventors: Steven K. Aderholt, 4200 Palacio Dr., Amarillo, Tex. 79109; Franklin Billy Piehl, P.O. Box 244, Bushland, Tex. 79102

[21] Appl. No.: 09/336,029

[22] Filed: Jun. 18, 1999

Related U.S. Application Data

[60] Provisional application No. 60/094,538, Jul. 29, 1998.

[51] Int. Cl.[7] ..... B65B 1/04

[52] U.S. Cl. ..... 222/397; 137/68.21; 137/68.23

[58] Field of Search ..... 222/397; 137/68.19, 137/68.21, 68.23, 68.28

[56] References Cited

U.S. PATENT DOCUMENTS

| | | |
|---|---|---|
| 1,951,926 | 3/1934 | Davidson . |
| 2,213,878 | 9/1940 | Boyle . |
| 2,383,961 | 9/1945 | Freygang . |
| 2,662,546 | 12/1953 | Nelson . |
| 3,404,698 | 10/1968 | Rouse . |
| 3,618,626 | 11/1971 | Russo . |
| 4,077,422 | 3/1978 | Brinkley et al. . |
| 4,907,617 | 3/1990 | Whalen . |
| 4,944,424 | 7/1990 | Wood, Jr. . |
| 5,022,423 | 6/1991 | Britt . |
| 5,103,853 | 4/1992 | McGushion et al. . |
| 5,160,065 | 11/1992 | Libes et al. . |
| 5,832,947 | 11/1998 | Niemczyk . |

*Primary Examiner*—Steven O. Douglas

[57] ABSTRACT

The present invention is a relief device for a high-pressure gas container, comprising a main body having a generally uniform outer circumference that defines a bore. The bore is in fluid communication with an interior volume of the high-pressure gas container. Within the bore is a rupture disc for relieving to the atmosphere the container's contents when the container reaches a certain pressure. The relief device is coupled to the high-pressure gas container via a threaded connection. In a preferred embodiment, the bore comprises a primary bore coaxial with the main body's main axis, and at least one secondary bore containing the rupture disc, each bore being in fluid communication with one another. The secondary bore and rupture disc are each located within the main body's outer circumference. A cluster nut, threaded at its upstream end to engage corresponding threads in the secondary bore, retains the rupture disc within the secondary bore. The cluster nut has a bore in fluid communication with the secondary bore when the rupture disc is ruptured. Depending upon the gas in the container, the cluster nut may be filled with a fuse metal, designed to melt at a predetermined temperature, that allows container relief in the event of bursting of the rupture disc.

21 Claims, 6 Drawing Sheets

CLUSTER-TYPE RELIEF DEVICE

This application claims the benefits of the earlier filed U.S. Provisional Application Ser. No. 60/094,538, filed Jul. 29, 1998 (29.07.1998), which is incorporated by reference for all purposes into this application.

BACKGROUND OF THE INVENTION

1. Field of the Invention

The present invention relates generally to relief devices for tanks containing high-pressure gasses. More specifically, the present invention relates to relief devices for truck-borne compressed gas cylinders.

2. Description of the Related Art

Various types of compressed gases are commonly transported in long, narrow cylinders, or "tubes," mounted directly on a tractor trailer chassis or in a "module," a box frame containing the cylinders that is loaded onto a flat bed trailer. These truck-borne compressed gas cylinders are typically fitted at each end with cluster-type relief devices that are designed to relieve pressure from compressed gas cylinders in the event of cylinder over-pressurization or fire. The present invention deals with an improved form of a cluster-type relief device.

FIGS. 1 and 2 illustrate a prior art cluster-type relief device. FIG. 1 is an exploded view of a prior art cluster-type relief device's interaction with its associated compressed gas cylinder, illustrating the cylinder 41, an "O" ring 47, a backup ring 48, a "bullplug" 42, the prior art cluster-type relief device 40, and a valve 49. As shown in FIG. 1, the relief device 40 does not attach directly to the cylinder 41. Rather, the relief device 40 screws into bullplug 42, which in turn screws into the cylinder 41. (The "O" ring 47 and backup ring 48 help create a seal between the bullplug 42 and the cylinder 41.) Thus, the bullplug 42 has two sets of threads: a set of male straight threads 43 that engage a reciprocal female set 44 in the cylinder; and a set of female pipe threads 45 that engage a reciprocal set of male pipe threads 46 on the relief device 40. Each set of threads 43, 45 on the bullplug 42 represents a potential leak or failure point. Moreover, having the relief device 40 screw into the bullplug 42, which in turn screws into the cylinder 41, means that the relief device protrudes farther from the cylinder than it would if the relief device screwed directly into the cylinder. This greater protrusion presents a greater opportunity for a shear of the relief device from the cylinder in the event of an accident, resulting in uncontrolled compressed gas leakage.

FIG. 2 is a close-up exploded view of a prior art cluster-type relief device. As shown in FIG. 2, the prior art relief device comprises a main body 55 and sets of washers 50 (typically made of silver, copper, or other suitable metal), rupture discs 51, and cluster nuts 52. The operation of the cluster nuts 52 and their associated rupture discs 51 is described below—prior art cluster-type relief devices and the present invention operate to relieve pressure in essentially the same manner. These relief devices typically have three, five, or six sets of cluster nuts 52, washers 50, and discs 51. FIG. 2 illustrates a device with six such sets—one for each face of its hex head.

FIG. 2 illustrates how the cluster nuts 52 protrude beyond the diameter of the main body 55. This protrusion presents yet another opportunity for shear in the event of an accident, which in this case is the shear of the cluster nut head away from its threaded portion. In the event of a cluster nut head shear, the rupture disc and the threaded portion of the cluster nut will remain intact and in place within the relief device body. However, a cluster nut head shear greatly increases the likelihood that the relief device will relieve prematurely or accidentally outside of its design parameters.

Therefore, a need exists for a cluster-type relief device that attaches directly to its associated compressed gas tank, rather than via a bullplug, thereby lessening the likelihood of 1) leakage past a threaded connection and 2) relief device shear—and the associated uncontrolled leakage—in the event of an accident. Furthermore, a need exists for a cluster-type relief device with cluster nuts that do not protrude beyond the diameter of the device body, lessening the likelihood of cluster nut shear and the associated increased likelihood of premature relief.

Accordingly, the present invention provides a cluster-type relief device for compressed gas cylinders that attaches directly to its cylinder rather than threading into a bullplug. It is a further object of this invention to provide a cluster-type relief device for compressed gas cylinders that protects its cluster nuts from shear in the event of an accident. Thus, the present invention features a larger diameter threaded connection that may be threaded directly into the cylinder in place of a bullplug. Moreover, the present invention's cluster nut heads are recessed into the relief device body, thereby greatly reducing or eliminating the chance of accidental cluster nut head shear.

SUMMARY

The present invention is a cluster-type relief device for compressed gas cylinders, comprising a main body and cluster nuts. The main body of the relief device features a connection that may be threaded directly into the cylinder, thereby eliminating the need for a bullplug and removing one potential source of leakage past a threaded connection. The cluster nut heads are recessed into the main body, thereby greatly reducing or eliminating the chance of accidental cluster nut head shear.

In a preferred embodiment, the main body has an axial—or primary—bore concentric with its longitudinal axis and at least one radial—or secondary—bore perpendicular to its longitudinal axis, each radial bore having a cluster nut associated therewith. The radial bores are shaped such that the cluster nuts' heads are contained within the diameter of the main body, reducing the chance of accidental cluster nut head shear. The axial and radial bores are in fluid connection with each other and with the interior of the high-pressure gas container.

The cluster nuts typically engage the main body via a threaded connection. When the cluster nuts are threaded onto the main body, they retain the rupture discs against the main body. Each cluster nut has an axial bore in fluid connection with an interior volume of the main body and at least one radial bore perpendicular to the cluster nut's axis and through one of the faces of the cluster nut head. Each cluster nut may be filled with a fuse metal that melts at a given temperature. When the cylinder pressure exceeds the rupture disc's burst pressure and the fuse metal (if present) melts, the pressure of the compressed gas is relieved.

BRIEF DESCRIPTION OF THE DRAWINGS

For a more complete understanding of the present invention, and for further details and advantages thereof, reference is now made to the following Detailed Description taken in conjunction with the following drawings, in which.

DETAILED DESCRIPTION OF THE INVENTION

The present invention comprises generally a main body having an outer circumference, a threaded connection for coupling the main body to a compressed gas cylinder, rupture discs that rupture and relieve container pressure in the event of an over-pressure event or fire, and cluster nuts that retain the rupture discs against the main body within the outer circumference. This disclosure describes numerous specific details that include specific structures, their arrangement, and functions in order to provide a thorough understanding of the present invention. One skilled in the art will appreciate that one may practice the present invention without these specific details.

Figure 1:
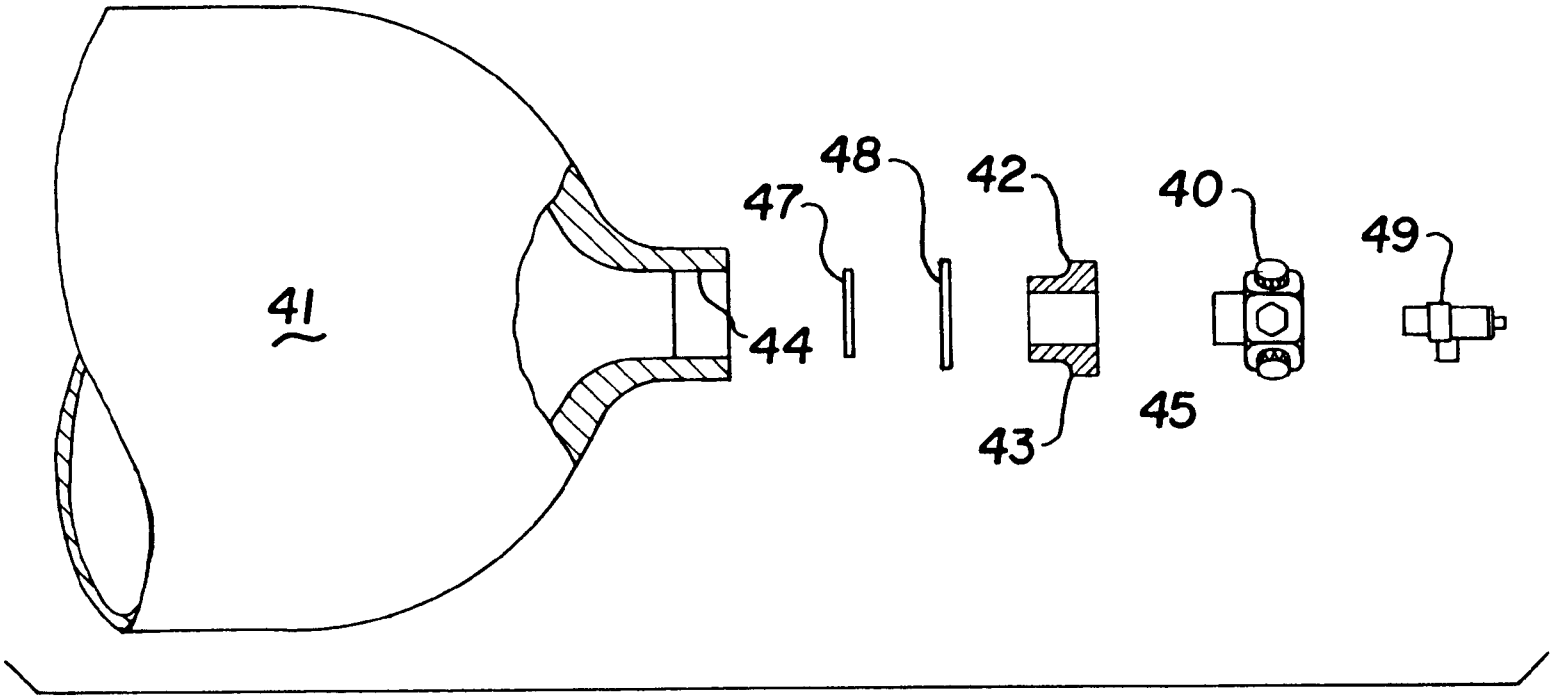
Fig. 1 (PRIOR ART)
FIG. 1 is an exploded view of a prior art cluster-type relief device's interaction with its associated compressed gas cylinder.
Figure 2B:
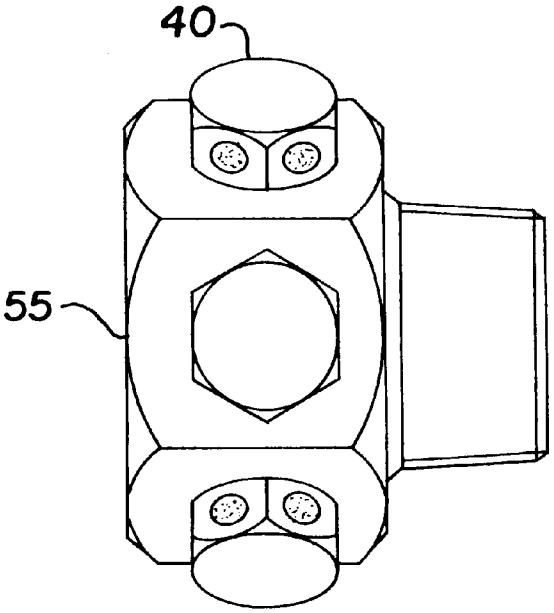
Fig. 2B (PRIOR ART)
FIG. 2 is a close up exploded view of a prior art cluster-type relief device.
Figure 2A:
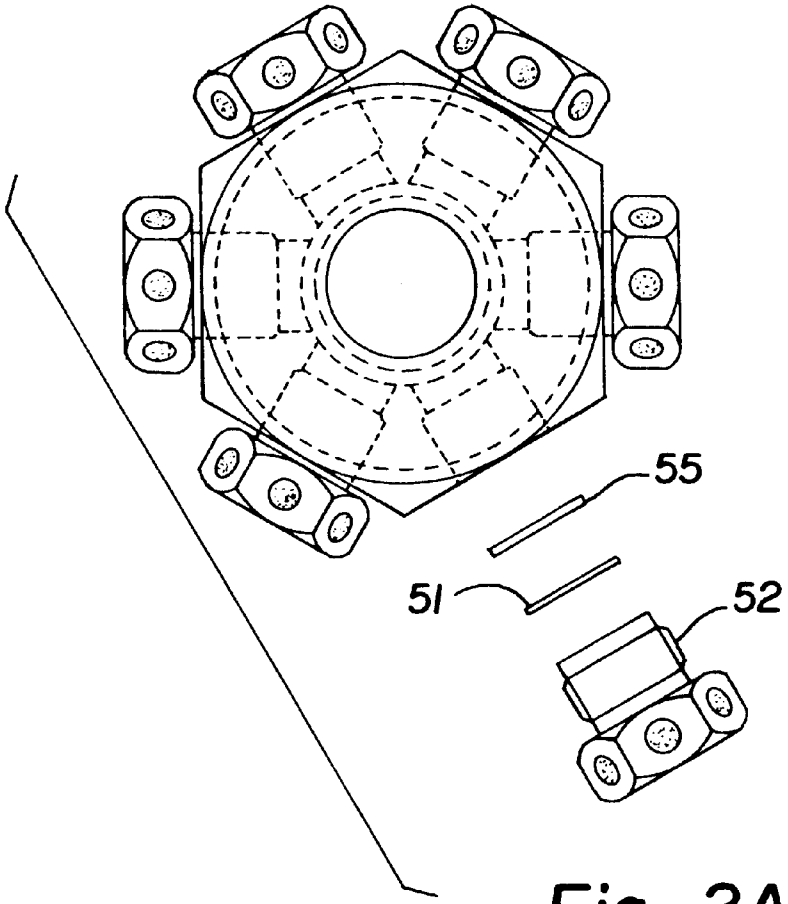
Fig. 2A (PRIOR ART)
Figure 3:
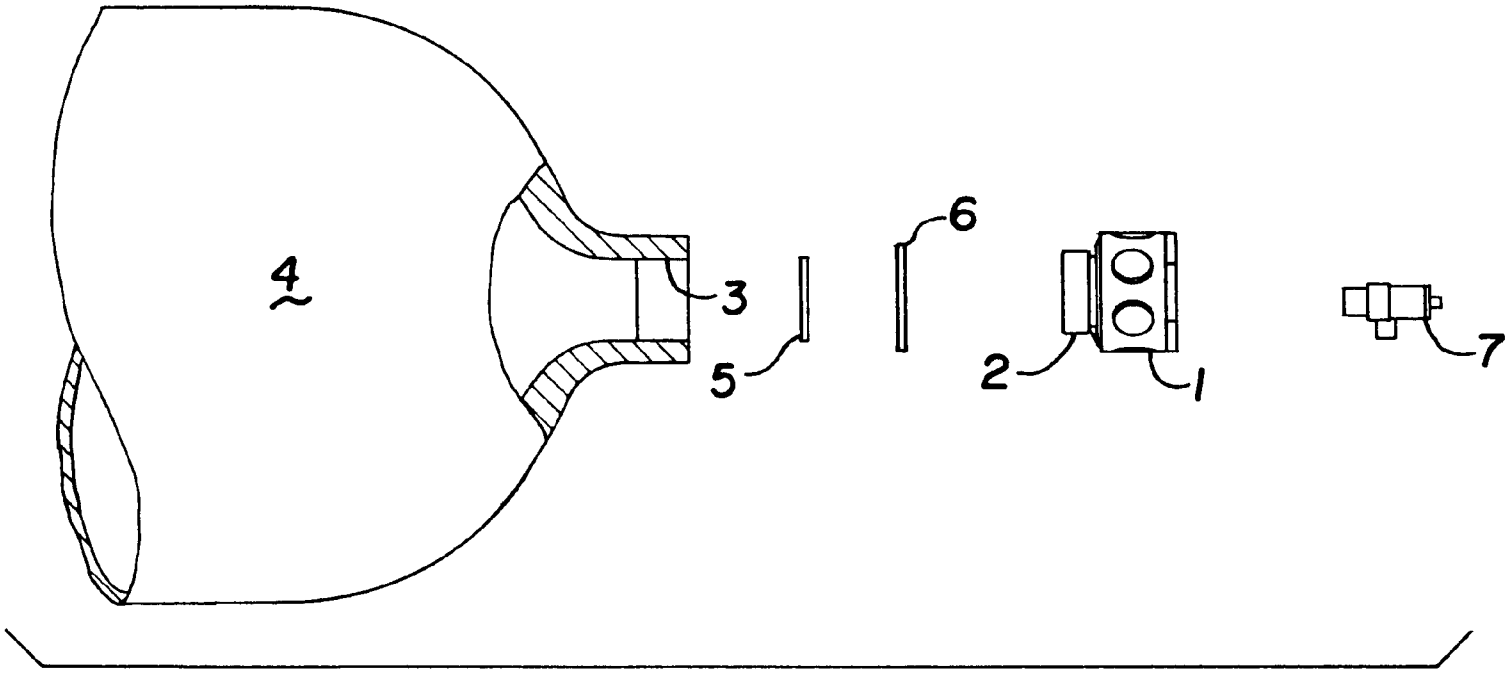
FIG. 3 is an exploded view of the present invention's interaction with its associated compressed gas cylinder.

Referring now to the figures, FIG. 3 is an exploded view of the present invention's interaction with its associated compressed gas cylinder, illustrating the gas cylinder 4, an "O" ring 5, a backup ring 6, the relief device 1, and a valve 7. As shown in FIG. 3, the present invention 1 has larger male threads 2 that screw directly into the female threads 3 of the compressed gas cylinder 4, thereby eliminating the need for a bullplug and removing one potential source of leakage past a threaded connection. An "O" ring 5 (typically made of rubber) and a backup ring 6 (typically made of a synthetic, fluorine-containing resin, such as TEFLON) help to create a seal between the relief device 1 and cylinder 4. A valve 7 or a plug (not shown) threads into the rear, or downstream, side of the device 1, allowing the operator to manually control gas flow from the cylinder.

Figure 4B:
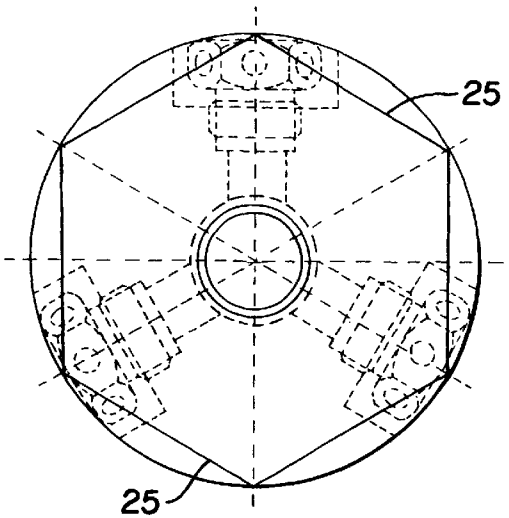
FIG. 4 is a close up exploded and partial cutaway view of the present invention having three fuse metal-filled cluster nuts.
Figure 4A:
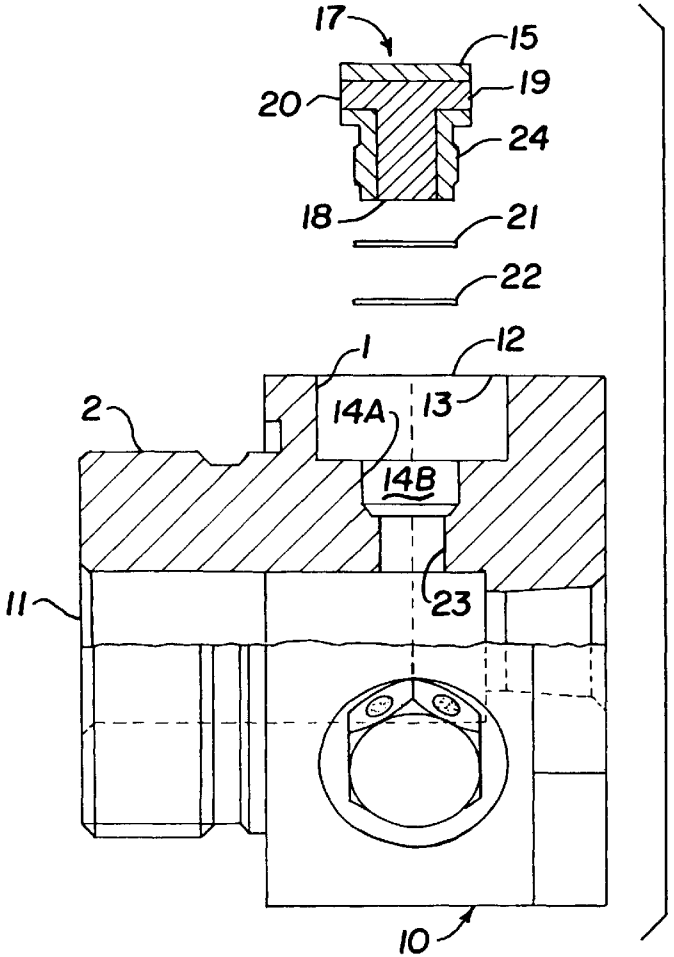

FIG. 4 illustrates a close-up and partial cutaway view of the improved cluster-type relief device itself, having three fuse metal-filled cluster nuts. As shown in FIG. 4, the main body 10 has a bore 11 concentric with its longitudinal axis and radial bores 12 perpendicular to the main body's axis, each radial bore having a cluster nut associated therewith. The axial bore 11 and radial bores 12 are in fluid communication with one another. The radial bores 12 are bored to three different diameters: The outermost, largest diameter portion 13 of the radial bore is bored to accept the cluster nut's hex head. The middle portion 14 of the radial bore is tapped to accept the male-threaded cluster nuts. The innermost portion of bore 12 provides a flowpath from the axial bore to the respective rupture discs. Annular surface 23 is formed at the junction of threaded portion 14 and bore 12. Thus, the cluster nuts' heads 15 are contained substantially within the diameter of the relief device body, greatly reducing the chance of accidental cluster nut head shear and improving the device's reliability. A hole 16 is tapped in the rightmost (as shown), or downstream, surface of the main body to accept a valve 7 (shown in FIG. 3) or a plug (not shown).

A washer 22 and a rupture disc 21 are held compressed against the surface 23 by a cluster nut 17. The washer 22, preferably made of silver, copper, or other suitable metal, rests on the surface 23, and provides a seal between the surface 23 and the cluster nut 17. The rupture disc 21 rests on top of the washer 22. The rupture disc 21 is a disc made of different metals depending upon the gas contained in the cylinder. For example, for a cylinder containing compressed hydrogen chloride gas (HCl), the rupture disc is made of platinum. The rupture disc 21 is designed to burst at a given pressure, called a "burst pressure", which varies depending upon the volume, pressure, and type of compressed gas contained in the cylinder. Moreover, the burst pressure is affected by extreme heat. Thus, in the event of a fire, the disc may burst at some pressure less than its design burst pressure. When the cylinder pressure reaches the burst pressure, the rupture disc 21 ruptures and allows the gas to escape through the cluster nuts 17, provided the cluster nut bores are not filled with fuse metal.

Cluster nuts 17 have male straight threads 24 that engage main body 10 at complimentary female straight threads 14*a*. Each cluster nut 17 has a bore 18 concentric with its axis, which does not extend all the way to the top surface of the cluster nut's hex head, and a bore 19 perpendicular to the cluster nut's axis and through each of the faces of the cluster nut head. These bores are in fluid communication with one another. Depending upon the gas contained in the cylinder, and typically when the gas is particularly poisonous or corrosive, the cluster nut bores may be filled with a fuse metal 20. The fuse metal 20 is indicated on the drawings by a shaded portion within the cluster nut. A fuse metal is a low melting-point metallic alloy that is designed to melt at a given temperature, typically either 165° F. or 212° F. The melting temperature is dictated by industry and government standards depending upon the application. Examples of 165° F. melting point applications include air, argon, carbon dioxide, and chlorine. Examples of 212° F. melting point applications include ethane and sulfur hexafluoride. Thus, in the event of a fire the fuse metal will melt away, clearing a flowpath—interrupted only by the rupture disc—from the device's main body's axial bore and radial bores directly to the atmosphere. When the cylinder pressure exceeds the rupture disc's burst pressure, and the fuse metal, if any, melts, the compressed gas is relieved from the cylinder.

The relief device body 10 and the cluster nuts 17 are typically manufactured from the same material, which will vary depending upon the application. For example, for an HCl application carbon steel is used. High purity gases requiring a low particle count, such as many refrigerants, require stainless steel, such as 304 or 316 stainless steel.

The relief device and the cluster nuts are to be torqued to specifications that will depend upon the application. Flat hex surfaces 25 allow the operator to use a wrench to install the relief device to the compressed gas cylinder.

Figure 5B:
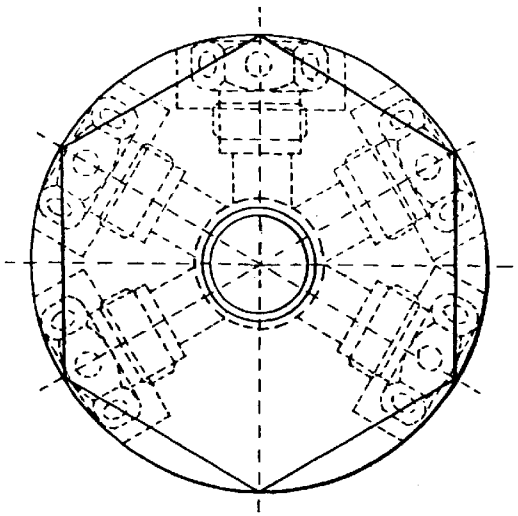
FIG. 5 is a close up exploded and partial cutaway view of the present invention having five fuse metal-filled cluster nuts.
Figure 5A:
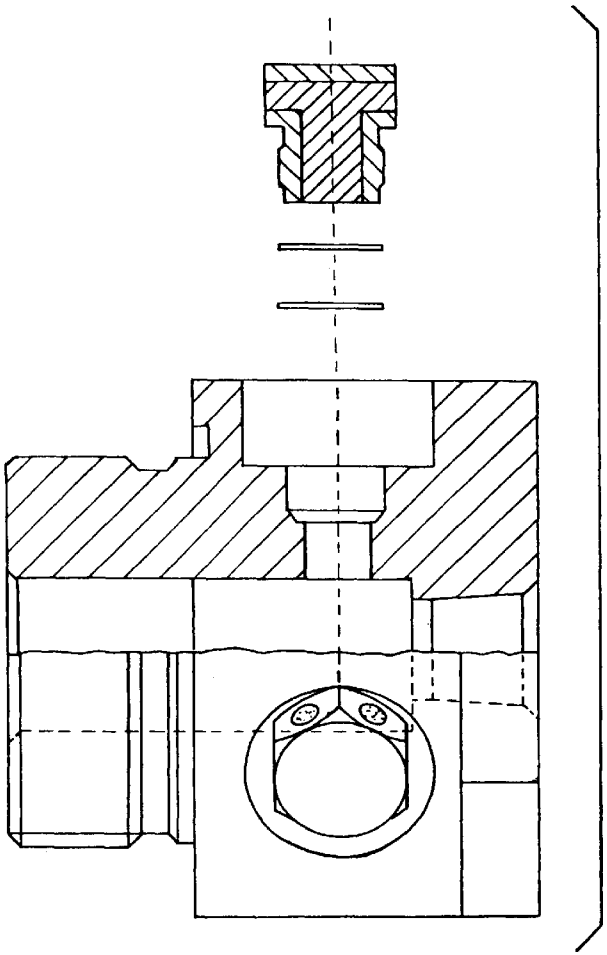
Figure 6B:
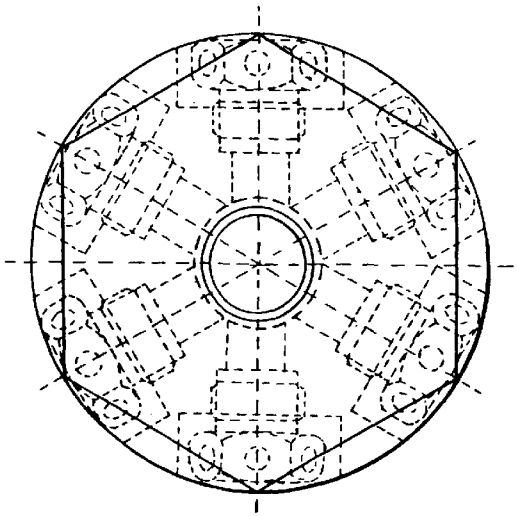
FIG. 6 is a close up exploded and partial cutaway view of the present invention having six fuse metal-filled cluster nuts.
Figure 6A:
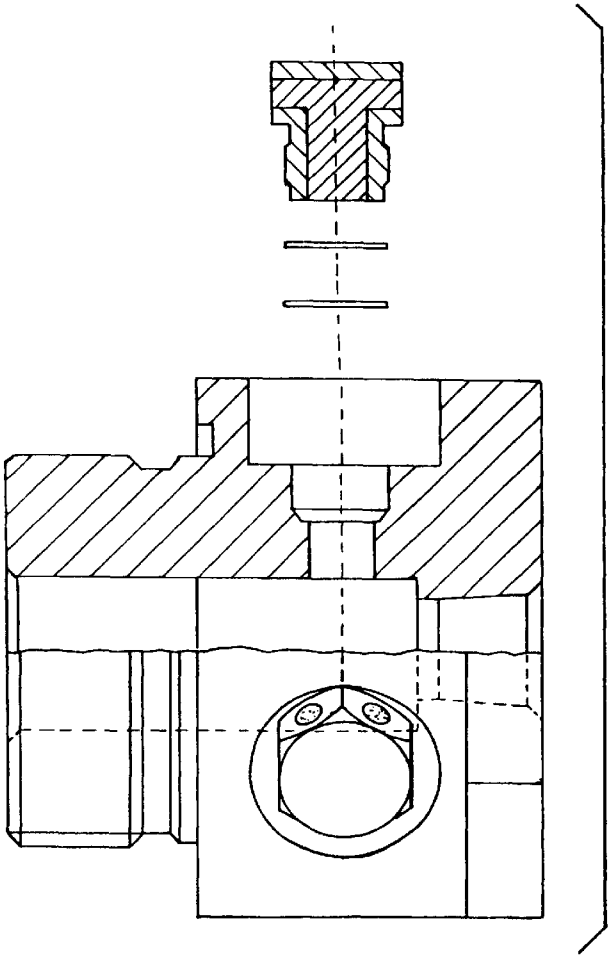

FIGS. 5 and 6 illustrate close-up and partial cutaway views of alternative embodiments of the improved cluster-type relief device itself, having five and six fuse metal-filled cluster nuts, respectively.

Thus, the present invention is a cluster-type relief device for compressed gas cylinders, comprising a main body and cluster nuts. The main body of the relief device features a connection that may be threaded directly into the cylinder, thereby eliminating the need for a bullplug and removing one potential source of leakage past a threaded connection. The cluster nut heads are recessed into the main body, thereby greatly reducing or eliminating the chance of accidental cluster nut head shear.

In a preferred embodiment, the main body has an axial bore concentric with its longitudinal axis and at least one radial bore perpendicular to its longitudinal axis, each radial bore having a cluster nut associated therewith. The radial bores are shaped such that the cluster nuts' heads are contained within the diameter of the main body, reducing the chance of accidental cluster nut head shear. The axial and radial bores are in fluid connection with each other and with the interior of the high-pressure gas container.

The cluster nuts typically engage the main body via a threaded connection. When the cluster nuts are threaded onto the main body, they retain the rupture discs against the main body. Each cluster nut has an axial bore in fluid connection with an interior volume of the main body and at least one radial bore perpendicular to the cluster nut's axis and through one of the faces of the cluster nut head. Each cluster nut may be filled with a fuse metal that melts at a given temperature. When the cylinder pressure exceeds the rupture disc's burst pressure and the fuse metal (if present) melts, the pressure of the compressed gas is relieved.

Other embodiments of the invention will be apparent to those skilled in the art after considering this specification or practicing the disclosed invention. The specification and examples above are exemplary only, with the true scope of the invention being indicated by the following claims.

We claim the following invention:

1. A relief device for a high-pressure gas container, comprising:

a main body having a generally uniform outer circumference that defines a bore, said bore in fluid communication with an interior volume of the high-pressure gas container;

a rupture disc that relieves to the atmosphere the contents of the container when said container reaches a certain pressure, said rupture disc located within said bore and within the outer circumference of said main body;

a threaded connection for sealingly engaging the relief device directly to the container; and a cluster nut that is adapted at its upstream end to sealingly engage said main body and retain said rupture disc within said bore, said cluster nut having a cluster nut bore in fluid communication with said bore when said rupture disc is ruptured, said cluster nut bore in fluid communication with the atmosphere, said cluster nut being substantially within the outer circumference of said main body and further wherein at least a portion of said cluster nut bore is oriented to direct fluid flowing therethrough against an inner wall of said main body bore.

2. The relief device of claim 1, wherein said bore comprises a primary bore coaxial with a main axis of said main body, and at least one secondary bore comprising said rupture disc, said secondary bore and rupture disc each located within the outer circumference of said main body.

3. The relief device of claim 2, further comprising a washer between said rupture disc and said main body.

4. The relief device of claim 2, wherein said cluster nut bore is filled with a fuse metal that melts at a given temperature, clearing a flowpath through said cluster nut.

5. A relief device for a high-pressure gas container, comprising:

a main body having a generally uniform outer circumference that defines a bore, said bore in fluid communication with an interior volume of the high-pressure gas container;

a means for relieving to the atmosphere the contents of the container when said container reaches a certain pressure, said relieving means located within said bore and within the outer circumference of said main body such that the contents when relieved are directed against a wall of said bore;

a means for sealingly engaging the relief device directly to the container; and a retaining means that is adapted at its upstream end to sealingly engage said main body and retain said rupture disc within said bore, said retaining means providing a flowpath from said bore to the atmosphere when said relieving means is ruptured, said retaining means being substantially within the outer circumference of said main body.

6. The relief device of claim 5, wherein said sealing means comprises a threaded member corresponding to a threaded connection on the high-pressure gas container.

7. The relief device of claim 5, wherein said bore comprises a primary bore coaxial with a main axis of said main body, and a secondary bore comprising said relieving means, said secondary bore and relieving means each located within the outer circumference of said main body, said relieving means comprising a rupture disc.

8. The relief device of claim 5, wherein said retaining means comprises a cluster nut.

9. The relief device of claim 8, wherein said cluster nut is filled with a fuse metal.

10. A method that relieves the over-pressurization of a high-pressure gas container, comprising:

providing a main body having a generally uniform outer circumference that defines a bore, said bore in fluid communication with an interior volume of the high-pressure gas container;

providing a rupture disc that relieves to the atmosphere the contents of the container when said container reaches a certain pressure, said rupture disc located within said bore and within the outer circumference of said main body;

sealingly engaging the relief device directly to the container; and adapting a cluster nut at its upstream end to sealingly engage said main body and retain said rupture disc within the said bore, said cluster nut having a cluster nut bore in fluid communication with said bore when said rupture disc is ruptured, said cluster nut bore in fluid communication with the atmosphere, said cluster nut being substantially within the outer circumference of said main body and further wherein at least a portion of said cluster nut bore is oriented to direct fluid flowing therethrough against an inner wall of said main body bore.

11. The method of claim 10, wherein said bore comprises a primary bore coaxial with a main axis of said main body, and at least one secondary bore comprising said rupture disc, said secondary bore and rupture disc each located within the outer circumference of said main body.

12. The method of claim 11, further comprising providing a washer between said rupture disc and said main body.

13. The method of claim 11, wherein said cluster nut bore is filled with a fuse metal that melts at a given temperature, clearing a flowpath through said cluster nut.

14. A truck-borne compressed gas containment system, comprising:

a compressed gas cylinder for storing compressed gas, said compressed gas cylinder defining an opening therein; and a relief device retained in said opening, said relief device comprising:

a main body having a generally uniform outer circumference that defines a bore, said bore in fluid communication with an interior volume of the high-pressure gas container;

a rupture disc that relieves to the atmosphere the contents of the container when said container reaches a certain pressure, said rupture disc located within said bore and within the outer circumference of said main body;

a threaded connection for sealingly engaging the relief device directly to the container; and an cluster nut that is adapted at its upstream end to sealingly engage said main body and retain said rupture disc within said bore, said cluster nut having a cluster nut bore in fluid communication with said bore when said rupture disc is ruptured, said cluster nut bore in fluid communication with the atmosphere, said cluster nut being substantially within the outer circumference of said main body and further wherein at least a portion of said cluster nut bore is oriented to direct fluid flowing therethrough against an inner wall of said main body bore.

15. The system of claim 14, wherein said bore comprises a primary bore coaxial with a main axis of said main body, and at least one secondary bore comprising said rupture disc, said secondary bore and rupture disc each located within the outer circumference of said main body.

16. The system of claim 15, further comprising a washer between said rupture disc and said main body.

17. The system of claim 15, wherein said cluster nut bore is filled with a fuse metal that melts at a given temperature, clearing a flowpath through said cluster nut.

18. A method to manufacture an apparatus that relieves the over-pressurization of a high-pressure gas container, comprising:

providing a main body having a generally uniform outer circumference that defines a bore, said bore in fluid communication with an interior volume of the high-pressure gas container;

providing a rupture disc that relieves to the atmosphere the contents of the container when said container reaches a certain pressure, said rupture disc located within said bore and within said outer circumference;

sealingly engaging the relief device directly to the container; and adapting a cluster nut at its upstream end to sealingly engage said main body and retain said rupture disc within said bore, said cluster nut having a cluster nut bore in fluid communication with said bore when said rupture disc is ruptured, said cluster nut bore in fluid communication with the atmosphere, said cluster nut being substantially within the outer circumference of said main body and further wherein at least a portion of said cluster nut bore is oriented to direct fluid flowing therethrough against an inner wall of said main body bore.

19. The method of claim 18, wherein said bore comprises a primary bore coaxial with a main axis of said main body, and at least one secondary bore comprising said rupture disc, said secondary bore and rupture disc each located within the outer circumference of said main body.

20. The method of claim 19, further comprising providing a washer between said rupture disc and said main body.

21. The method of claim 19, wherein said cluster nut bore is filled with a fuse metal that melts at a given temperature, clearing a flowpath through said cluster nut.

* * * * *